US007634977B2

(12) United States Patent
Smith et al.

(10) Patent No.: US 7,634,977 B2
(45) Date of Patent: Dec. 22, 2009

(54) GAS WATER HEATER

(75) Inventors: Herbert Edward Smith, Sumter, SC (US); Gordon Stretch, Columbia, SC (US)

(73) Assignee: AOS Holding Company, Wilmington, DE (US)

( * ) Notice: Subject to any disclaimer, the term of this patent is extended or adjusted under 35 U.S.C. 154(b) by 142 days.

(21) Appl. No.: 11/464,998

(22) Filed: Aug. 16, 2006

(65) Prior Publication Data

US 2008/0066694 A1 Mar. 20, 2008

(51) Int. Cl.
*F24H 1/18* (2006.01)

(52) U.S. Cl. ..... 122/155.2; 122/13.01

(58) Field of Classification Search ..... 110/345; 122/13.01, 17.1, 155.2; 126/307 A
See application file for complete search history.

(56) References Cited

U.S. PATENT DOCUMENTS

| | | | | |
|---|---|---|---|---|
| 1,847,431 | A | 3/1932 | Hanna | |
| 1,993,725 | A | 3/1935 | Walker et al. | |
| 2,495,673 | A | 1/1950 | Erwin | |
| 2,543,835 | A | 3/1951 | Dewey | |
| 2,923,287 | A * | 2/1960 | Murphy | 126/110 AA |
| 3,028,843 | A | 4/1962 | Carlson et al. | |
| 3,756,202 | A | 9/1973 | Keith | |
| 3,757,745 | A | 9/1973 | Miller | |
| 3,903,868 | A | 9/1975 | Salvo | |
| 4,203,392 | A | 5/1980 | McLane | |
| 4,232,656 | A | 11/1980 | Teagan | |
| 4,329,943 | A | 5/1982 | Schwörer | |
| 4,380,215 | A | 4/1983 | Mendelson | |
| 4,398,502 | A | 8/1983 | Park | |
| 4,414,464 | A | 11/1983 | Cloutier | |
| 4,445,464 | A | 5/1984 | Gerstmann et al. | |
| 4,492,185 | A | 1/1985 | Kendall et al. | |
| 4,497,281 | A | 2/1985 | Markus | |
| 4,501,232 | A | 2/1985 | Gordbegli et al. | |
| 4,531,509 | A | 7/1985 | Wilhelm, Jr. | |
| 4,541,410 | A | 9/1985 | Jatana | |
| 4,574,779 | A | 3/1986 | Hayes | |
| 4,637,347 | A | 1/1987 | Troy | |
| 4,641,631 | A | 2/1987 | Jatana | |
| 4,646,713 | A * | 3/1987 | Honigsbaum | 126/79 |
| 4,651,714 | A | 3/1987 | Granberg | |

(Continued)

FOREIGN PATENT DOCUMENTS

| | | | |
|---|---|---|---|
| EP | 0163764 | A2 | 12/1985 |

(Continued)

*Primary Examiner*—Gregory A Wilson
(74) *Attorney, Agent, or Firm*—Michael Best & Friedrich LLP

(57) ABSTRACT

A gas water heater includes a power burner, a flue tube, an exhaust plenum, and a draft hood. The flue tube includes a portion that describes at least a 360° loop. Products of combustion are forced through the flue tube under the influence of the power burner, and enter the exhaust plenum. In the exhaust plenum, the pressure of the products of combustion drops such that the products of combustion flow into the draft hood substantially entirely under the influence of natural convection. In one embodiment, the power burner fires down into the flue tube through a side wall of the water heater, the loop of the flue tube is near the bottom of the water heater, and the plenum is in the top of the water heater.

5 Claims, 5 Drawing Sheets

U.S. PATENT DOCUMENTS

| | | | | |
|---|---|---|---|---|
| 4,653,434 | A | | 3/1987 | Wilhelm, Jr. |
| 4,658,803 | A | | 4/1987 | Ball et al. |
| 4,660,541 | A | | 4/1987 | Moore |
| 4,672,919 | A | | 6/1987 | Staats |
| 4,677,939 | A | | 7/1987 | Henault et al. |
| 4,685,425 | A | | 8/1987 | Eising |
| 4,699,122 | A | | 10/1987 | Jannemann et al. |
| 4,766,883 | A | | 8/1988 | Cameron et al. |
| 4,771,762 | A | | 9/1988 | Bridegum |
| 4,785,792 | A | | 11/1988 | Saint Laurent |
| 4,809,523 | A | | 3/1989 | Vandenberg |
| 4,852,524 | A | | 8/1989 | Cohen |
| 4,867,106 | A | | 9/1989 | Staats |
| RE33,082 | E | | 10/1989 | Gerstmann et al. |
| 4,875,465 | A | | 10/1989 | Kramer |
| 4,917,077 | A | | 4/1990 | Scanferla |
| 4,938,204 | A | | 7/1990 | Adams |
| 4,981,112 | A | | 1/1991 | Adams et al. |
| 5,022,352 | A | | 6/1991 | Osborne et al. |
| 5,069,169 | A | | 12/1991 | Maruko |
| 5,179,914 | A | | 1/1993 | Moore, Jr. et al. |
| 5,195,502 | A | | 3/1993 | Hanning |
| 5,197,415 | A | | 3/1993 | Stretch et al. |
| 5,207,211 | A | | 5/1993 | Hanning et al. |
| 5,228,413 | A | * | 7/1993 | Tam ..... 122/15.1 |
| 5,357,907 | A | | 10/1994 | Moore, Jr. et al. |
| 5,437,249 | A | | 8/1995 | Adams et al. |
| 5,582,026 | A | | 12/1996 | Barto, Sr. |
| 5,636,598 | A | | 6/1997 | Moore, Jr. |
| 5,699,756 | A | | 12/1997 | Ross et al. |
| 5,713,310 | A | | 2/1998 | Lemke |
| 5,735,237 | A | | 4/1998 | Phillip et al. |
| 5,749,415 | A | | 5/1998 | Dinh |
| 5,761,279 | A | | 6/1998 | Lannes |
| 5,775,268 | A | | 7/1998 | Ferguson |
| 5,816,199 | A | * | 10/1998 | Khizh et al. ..... 122/367.1 |
| 5,915,960 | A | | 6/1999 | Check et al. |
| 6,036,480 | A | | 3/2000 | Hughes et al. |
| 6,062,174 | A | | 5/2000 | Abe |
| RE37,240 | E | | 6/2001 | Moore, Jr. et al. |
| 6,591,788 | B2 | | 7/2003 | Hughes et al. |
| 6,679,014 | B2 | | 1/2004 | Hughes et al. |
| 6,681,723 | B1 | | 1/2004 | Amendt et al. |

FOREIGN PATENT DOCUMENTS

| | | | |
|---|---|---|---|
| JP | 2000304351 | A | 11/2000 |

* cited by examiner

GAS WATER HEATER

BACKGROUND

The present invention relates to a gas water heater, and more particularly to a gas water heater that utilizes a power burner and an exhaust plenum to permit natural convection exhaust of products of combustion, or a coiled flue tube, or a combination of power burner, coiled flue tube, and exhaust plenum.

SUMMARY

In one embodiment, the invention provides a water heater comprising a water storage tank having a side, top, and bottom, the tank having a first hole in the side of the tank and a second hole in one of the top and bottom of the tank, a heat exchanger having an inlet end and an outlet end, the inlet end secured in one of the first and second holes and the outlet end secured in the other of the first and second holes, the heat exchanger describing at least a 360° loop between the inlet and outlet ends, and a burner mounted in the inlet end of the heat exchanger to provide a flow products of combustion into the heat exchanger.

In some embodiments, the inlet end of the heat exchanger is secured in the first hole, and the outlet end of the heat exchanger is secured in the second hole, which is in the top of the water heater. In some embodiments, the water heater may also include a plenum in the top of the tank. In such embodiments, the outlet end of the heat exchanger communicates with the plenum such that the pressure of the products of combustion are reduced as they exit the heat exchanger, and the products of combustion exhaust from the water heater substantially entirely under the influence of natural convection.

In another embodiment the invention provides a method of manufacturing a water heater, the method comprising forming a water storage tank having a side, top and bottom, forming a first hole in the side of the tank, and a second hole in one of the top and bottom of the tank, forming a heat exchanger from a straight metal tube by bending the tube to form an at least 360° loop, the heat exchanger having an inlet end and an outlet end with the at least 360° loop in between, securing the inlet end of the heat exchanger in the first hole of the tank, and securing the outlet end of the heat exchanger in the second hole of the tank.

In yet another embodiment the invention provides a method of interfacing a natural convection vent construction with a water heater having a flue and a power burner providing products of combustion to the flue under positive pressure, the method comprising interposing an exhaust plenum between the flue and the natural convection vent construction, lowering the pressure of the products of combustion within the plenum, and permitting the products of combustion to rise out of the plenum and into the natural convection vent construction substantially entirely under the influence of natural convection.

In still another embodiment the invention provides a method for heating water in a water storage tank with a power burner, the method comprising forcing, under the influence of the power burner, products of combustion downwardly in the tank, then turning the products of combustion at least 360° within the tank, then forcing, under the influence of the power burner, products of combustion upwardly in the tank, then expanding the products of combustion to decouple the products of combustion from the influence of the power burner, and then exhausting the products of combustion substantially entirely under the influence of natural convection.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
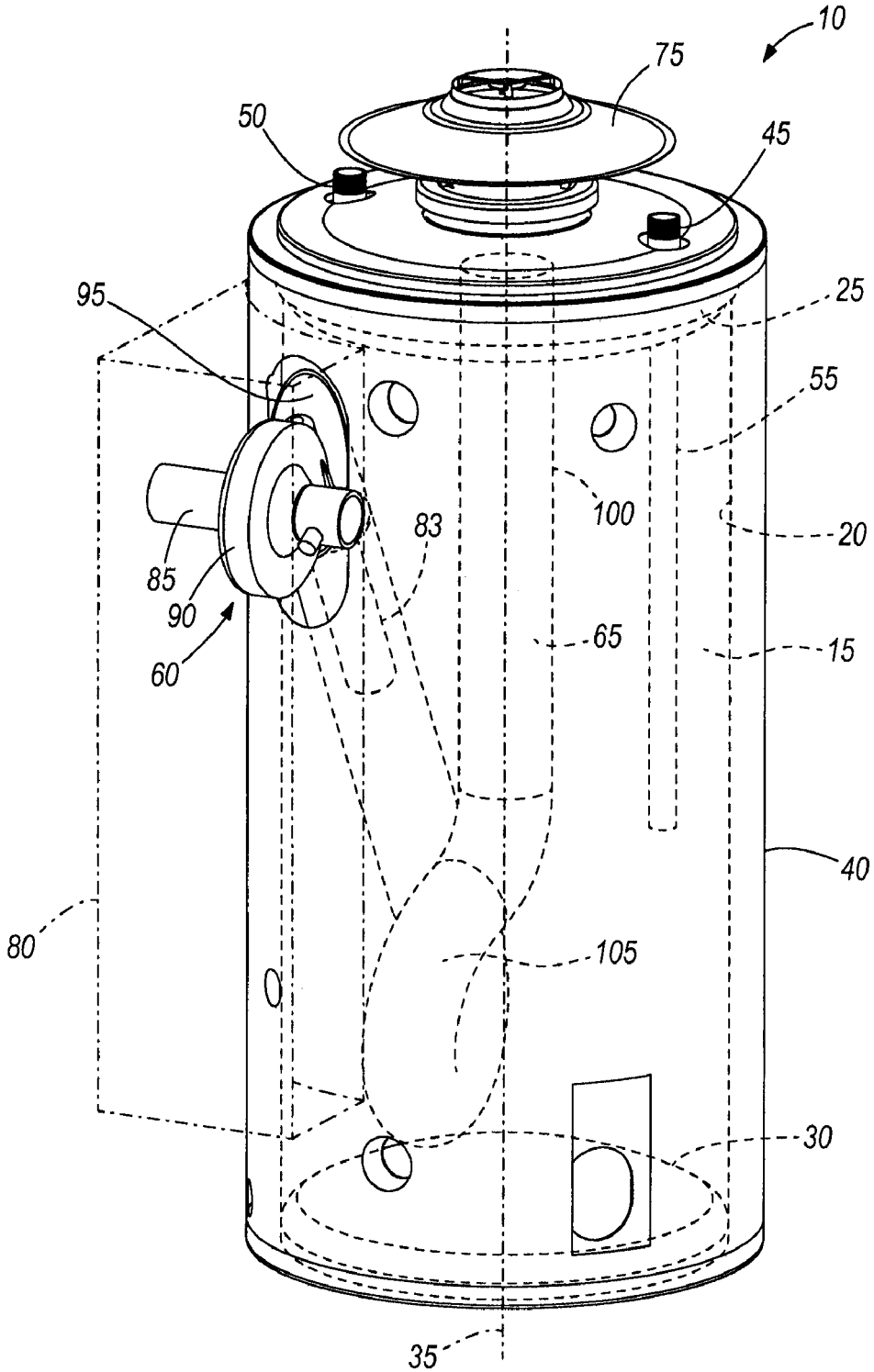
FIG. 1 is a perspective view of a water heater according to one embodiment of the present invention.
Figure 2:
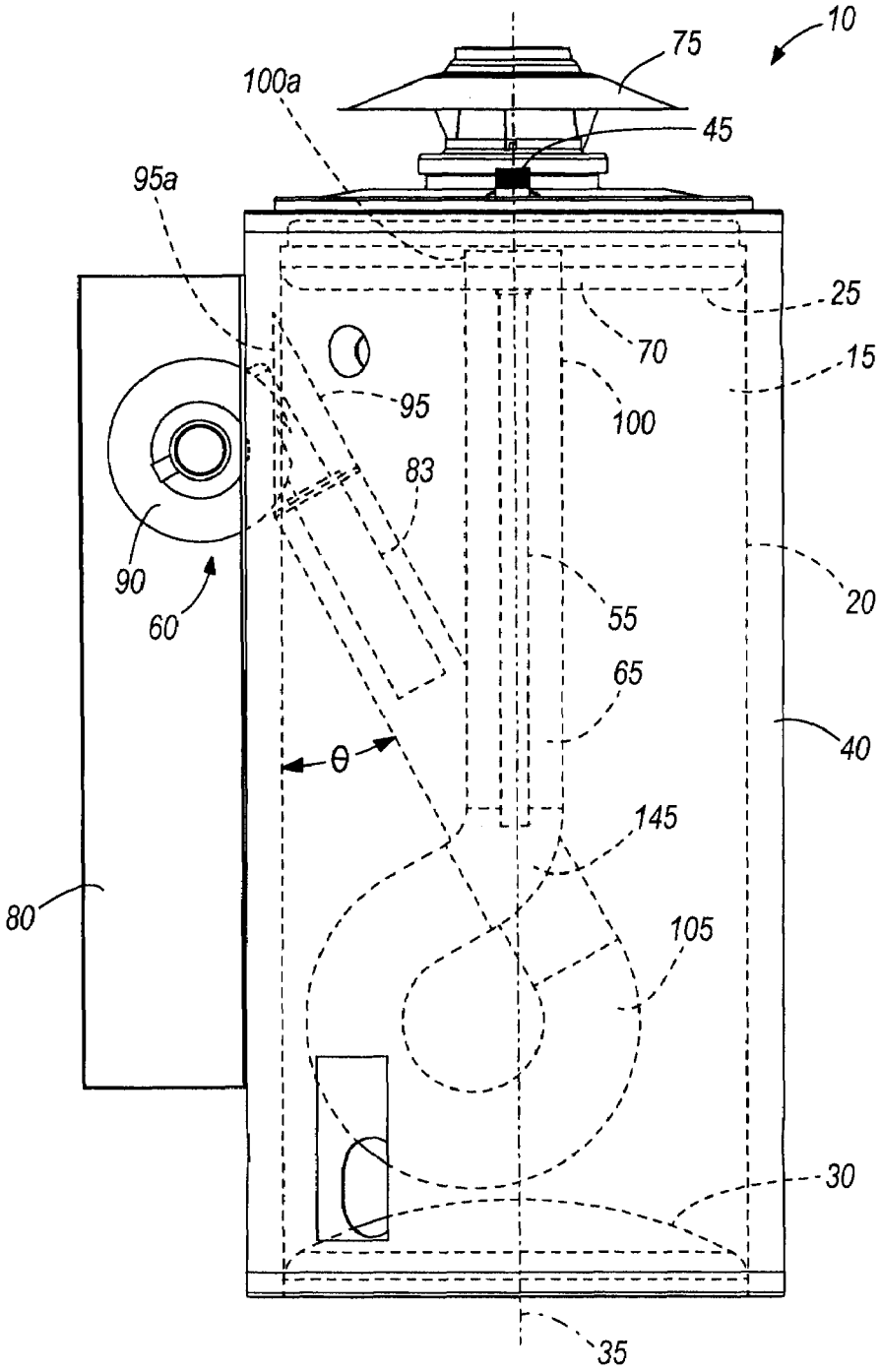
FIG. 2 is a side view of a water heater according to one embodiment of the present invention.

FIGS. 1 and 2 illustrate a water heater 10 including a generally cylindrical tank 15 having a side 20, a top 25 and a bottom 30. The illustrated tank 15 has a longitudinal tank axis 35 which in the illustrated embodiment is vertical, but could be horizontal in alternative embodiments. In such embodiments with a horizontal longitudinal tank axis 35, the tank 15 is tipped 90° such that what is illustrated as the top and bottom 25, 30 in FIGS. 1 and 2 become side walls of the tank 15, and the portion of the side 20 of the cylindrical tank 15 facing upwardly becomes the top of the tank 15. In other embodiments, the tank 15 may be provided in shapes other than cylindrical.

An insulating jacket 40 surrounds the tank 15. A cold water inlet spud 45 and a hot water outlet spud 50 are affixed to the top 25 of the tank 15. Cold and hot water pipes communicate with the inside of the tank 15 through the respective cold and hot water spuds 45, 50. A dip tube 55 extends into the tank 15 from the cold water inlet spud 45 to deliver cold water into the tank 15. Although the illustrated inlet and outlet spuds 45, 50 are on the top 25 of the tank 15, in other embodiments the spuds may also (or instead) be provided on the side 20 of the tank 15 to provide alternative options for connecting the cold and hot water pipes. Having spuds in multiple locations on the water heater helps to accommodate the various cold and hot water pipe connections that may be encountered in various buildings.

Water in the tank 15 is heated by means of a power burner 60, a heat exchanger or flue tube 65, an exhaust plenum 70, and a draft hood 75. Mounted to the side 20 of the tank 15 or to the insulation jacket 40 is an enclosure 80 that surrounds the power burner 60. The power burner 60 includes a premix burner 83 extending into the flue tube 65, an electric motor 85, and a blower 90. The burner 60 creates products of combustion by burning a fuel/air mixture, and the motor 85 drives the blower 90 to force the products of combustion into the flue tube 65 under positive pressure.

The flue tube 65 includes a straight segment 95 terminating in an inlet end 95*a* and a straight segment 100 terminating in an outlet end 100*a*. The flue tube 65 is substantially fully submersed in the water tank 15, with the inlet end 95*a* secured in a hole in the side 20 of the tank 15 and the outlet end 100*a* secured in a hole in the top 25 of the tank 15 and extending into the plenum 70. In other embodiments the inlet end 95*a* may be secured in a hole in the top 25 or bottom 30 of the tank 15, and the outlet end 100*a* may be secured in a hole in the side 20 or bottom 30 of the tank 15.

In the illustrated embodiment, the straight segment 95 extends downwardly into the tank 15 at an angle Θ of between about 20° and 45° with respect to vertical. The flue tube 65 then describes a loop 105 of at least 360° (i.e., there may be multiple loops). Although in the illustrated embodiment, the loop 105 is about an axis that is substantially perpendicular to the tank longitudinal axis 35 (i.e., perpendicular to the plane of FIG. 2), in other embodiments the loop 105 may be about a different axis, including an axis that is parallel and/or collinear with the tank longitudinal axis 35. From the loop 105, the straight segment 100 rises up to the exhaust plenum 70 within about 10° of vertical (i.e., within a 10° cone around the longitudinal axis 35).

Figure 3:
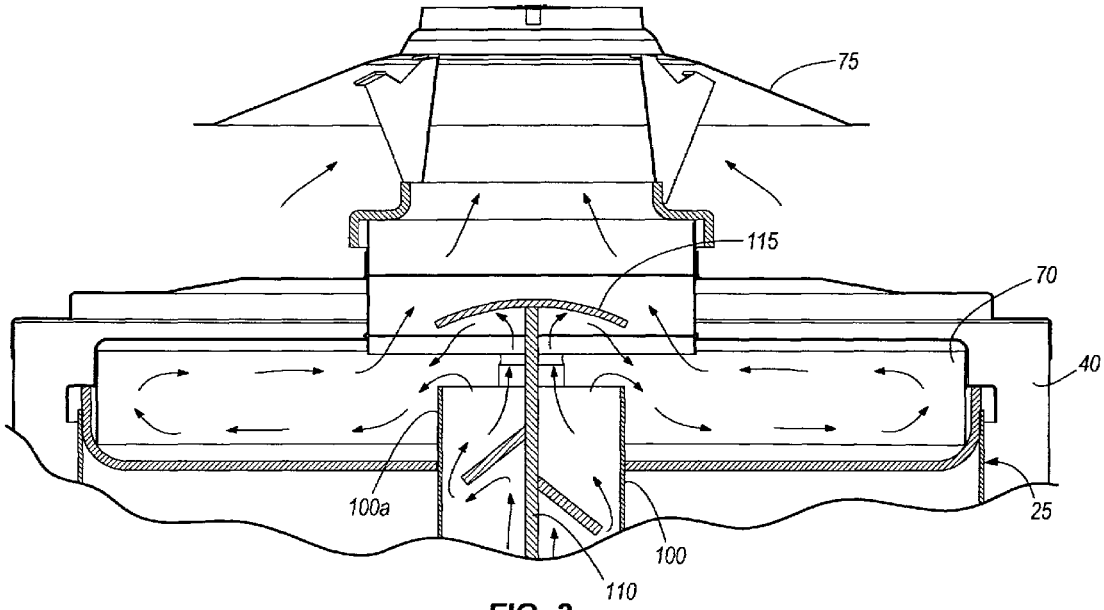
FIG. 3 is an enlarged view of the plenum portion in the top of the water heater.

With reference to FIG. 3, the flue tube 65 terminates in the plenum 70, which is part of the top 25 of the water tank 15. To facilitate cost-effective manufacturing, the flue tube 65 extends into the plenum 70 to the extent necessary (e.g., on the order of ¾") to weld the flue tube 65 to the plenum 70. In other embodiments, the flue tube 65 may be made flush with the bottom of the plenum 70 through a flange or other structural interface between the flue tube 65 and plenum 70. The same holds true for the connection of the inlet end 95*a* of the flue tube 65 to the water tank 15. The inlet end 95*a* may extend out of the tank 15 to facilitate welding, or may be flush-mounted.

A baffle 110 is positioned in the straight segment 100 of the flue tube 65 to reduce the velocity and pressure of the products of combustion as they approach the outlet end 100*a* of the flue tube 65. The shape and length of the baffle 110 may vary from what is illustrated, provided the basic functionality is met. The baffle 110 may be designed to reduce velocity and pressure of the products of combustion such that the products of combustion creep over the outlet end 100*a* of the flue tube 65 and "spill" into the plenum 70. Alternatively, the baffle 110 may include an optional deflector 115 that directs products of combustion down into the plenum 70 should the products of combustion have more velocity and pressure, in which case the deflector 115 prevents the products of combustion from rising directly into the draft hood 75. The baffle 110 may be supported by the outlet 100*a* of the flue tube 65 and may extend the entire length of the straight segment 100 down to the top of the loop 105. The flow of the products of combustion within the plenum 70 is represented by the arrows in FIG. 3. In the plenum 70, the pressure of the products of combustion drops near or below atmospheric pressure, and the products of combustion are therefore able to rise out of the plenum 70 and into the draft hood 75 substantially entirely under the influence of natural convection. In the draft hood 75, the products of combustion mix with ambient air (as represented by the additional arrows around the draft hood 75).

In this regard, the plenum 70 and baffle 110 may be said to uncouple the flow of the products of combustion from the power burner 60. In other words, the products of combustion enter the plenum 70 under the influence of the power burner 60, but exhaust from the plenum 70 without the influence of the power burner 60. Thus, the present water heater 10 can be retrofitted into a Category I venting system despite the fact that the water heater 10 utilizes a power burner 60.

The flue tube 65 is formed from a single, seamless tube that is bent to include the straight segments 95, 100 and the loop 105. The term "seamless" is used herein to describe a tube that includes no circumferential welded joints joining segments of the tube together, and is not intended to exclude tubes that have longitudinal (whether welded or not) seams created by forming the flue tube into a cylinder from a flat or curved sheet of metal. The flue tube 65 may be formed from a metallic material, such as stainless steel, aluminum, or another suitable material. Because the flue tube 65 is formed of a single, seamless tube, there are no welding joints between the inlet and outlet ends 95*a*, 100*a*. Weld joints and the material around weld joints are often particularly vulnerable to failure under fatigue, which may arise from the periodic heating and cooling in the normal operation of a water heater. The present invention therefore reduces the likelihood of fatigue failure within the flue tube by using a single seamless tube.

Figure 6:
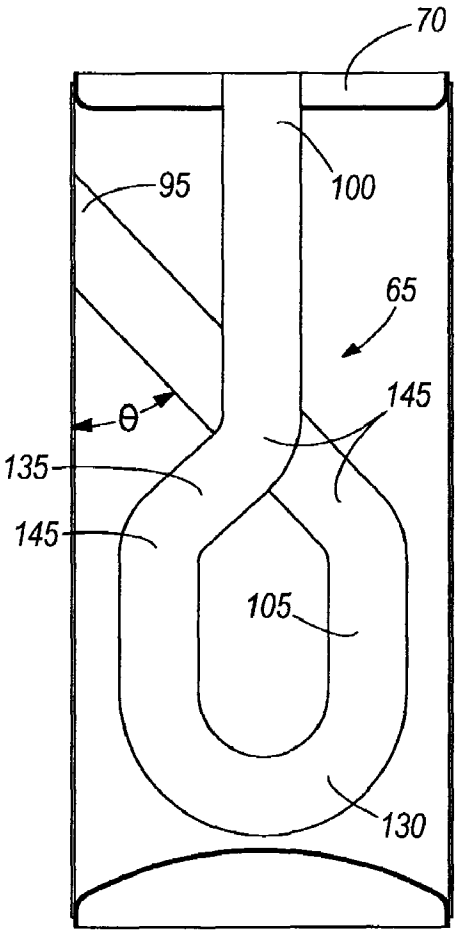
FIG. 6 is a side view of another alternative flue tube construction.
Figure 5:
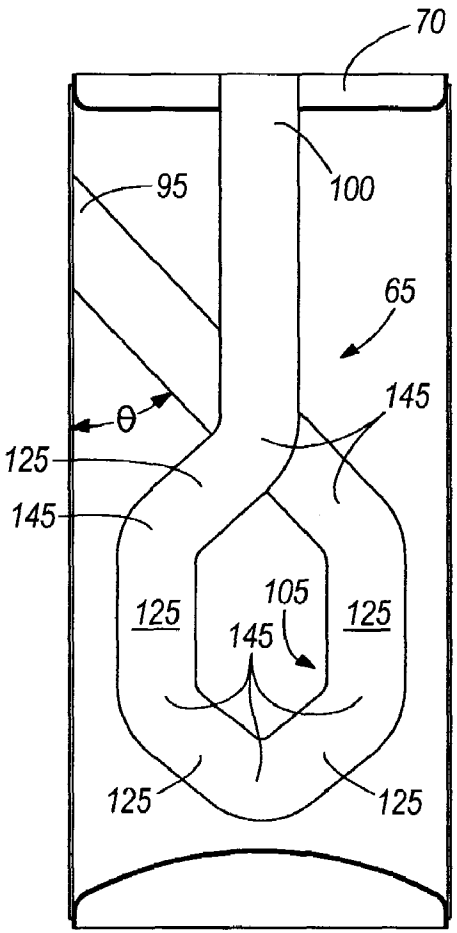
FIG. 5 is a side view of another alternative flue tube construction.
Figure 4:
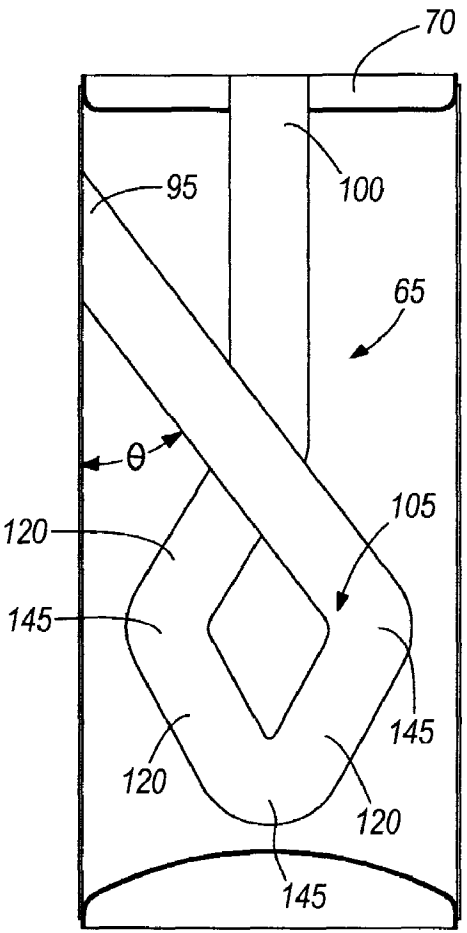
FIG. 4 is a side view of an alternative flue tube construction.
Figure 7:
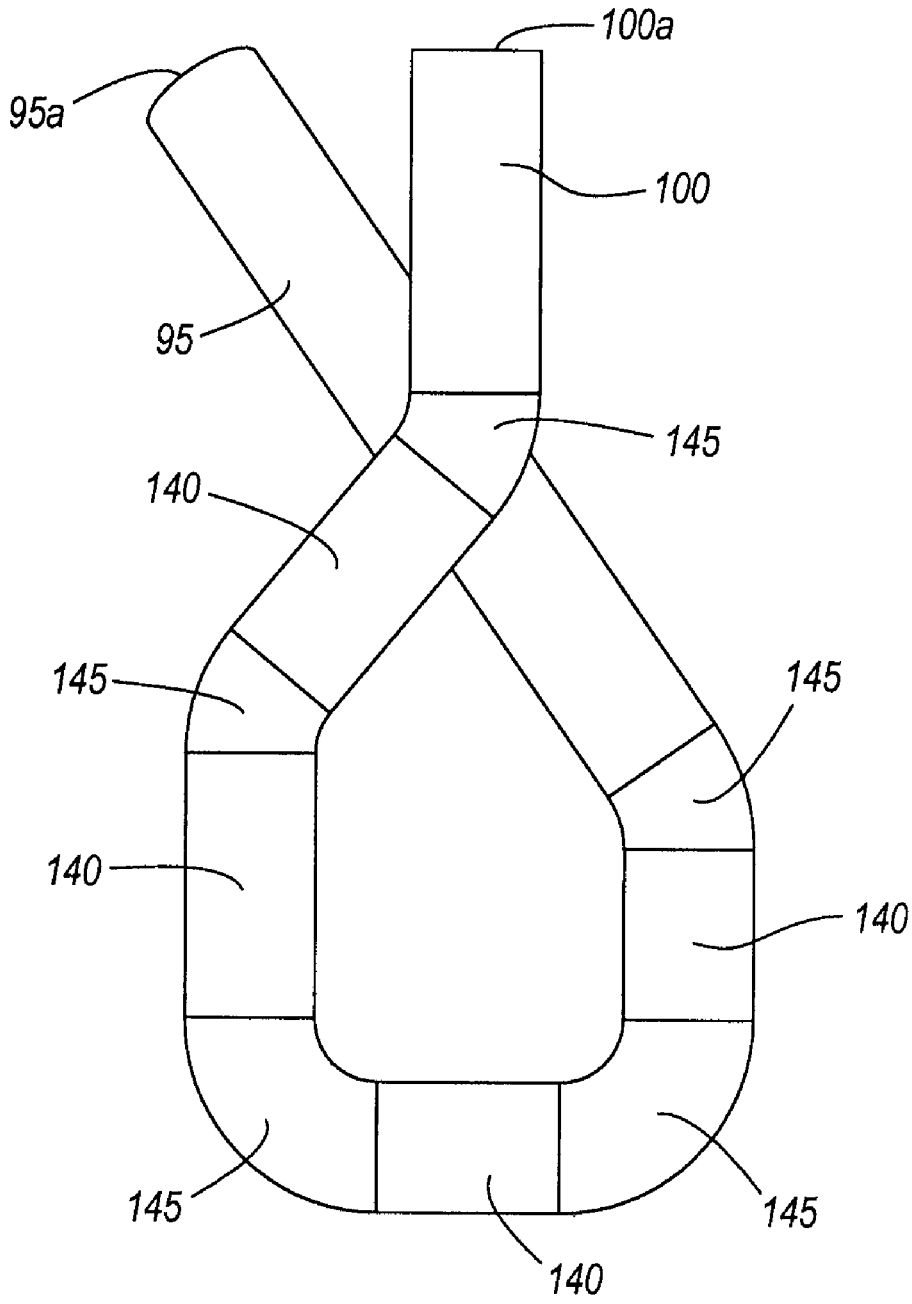
FIG. 7 is a side view of another alternative flue tube construction.

The loop sections 105 illustrated in FIGS. 2 and 4-7 are but a few examples of how the flue tube 65 may be bent to meet the requirements of the present invention. With reference to FIG. 2, the loop 105 describes a smooth, unbroken arc of between about 270° and 360°. In FIG. 4, the loop 105 includes three substantially straight segments 120. In FIG. 5, the loop 105 includes five substantially straight segments 125. In FIG. 6, the loop 105 includes a U-shaped portion 130 and substantially straight segment 135. In FIG. 7, the loop 105 includes four substantially straight segments 140. In each of FIGS. 2 and 4-7, the segments of the loop 105 and the straight segments 95, 100 are joined with transitional radiused corners 145 for smooth flow. The radiused corners 145 on either side of the substantially straight segment 140 at the bottom of the loop 105 in FIG. 7 describe arcs of about 90°, while the other radiused corners in the embodiments of FIGS. 2 and 4-7 describe smaller arcs.

The flue tube 65 provides the same efficiency as other heat exchangers but with less heat transfer area due to the turbulent flow of combustion gases through the flow pattern. The loop 105 of the flue tube 65 provides a longer flow path for combustion gases which leads to a higher level of heat transfer, and higher thermal efficiencies when compared to U-shaped or straight flues. Since this type of heat exchanger eliminates the need for a dry combustion chamber, scale and lime buildup is reduced, which extends the life of the tank 15. Also, since there is only one flue tube 65, there are fewer welds, which may result in lower cost of manufacturing and a longer life. The power burner 60 may be a low NOx burner that creates NOx emissions of less than 55 ppm, and in some cases less than 20 ppm.

A water heater according to the present invention provides greater tank capacity in a smaller tank and footprint than known water heaters. In one embodiment, for example, the water heater 10 has a height (measured from the bottom 30 of the tank 15 to the top of the draft hood 75) of less than 67.5 inches, a tank footprint not greater than 1,020 square inches, and a tank capacity of at least 71 gallons. A water heater in accordance with the present invention may have, for example, an efficiency of at least about 82%.

Manufacturing a water heater according to the present invention includes the steps of forming the water storage tank 15, providing a first hole in the side of the tank and a second hole in one of the top and bottom 25, 30 of the tank. While in the illustrated embodiment, the second hole is formed in the top 25 of the tank 15, in other embodiments it might be formed in the bottom 30. The heat exchanger 65 is then formed from a straight seamless metal tube, including the loop 105 between the inlet and outlet ends 95*a*, 100*a*. The inlet end 95*a* is secured (e.g., welded or fastened via a flange on the inlet end 95*a*) in the first hole and the outlet end 100*a* is secured in the second hole (e.g., is extended into the plenum 70). The power burner 60 is then inserted into the inlet end 95*a* of the flue tube 65 in order to force products of combustion into the flue tube 65. The draft hood is installed on top of the water heater 10 and communicates with the plenum 70. A water heater according to the present invention can replace an existing atmospheric water heater without the need to modify the exhaust structure. Because of the relatively high capacity-to-size ratio of a water heater according to the present invention, the present water heater should be able to retro-fit into the space occupied by most existing gas water heaters without reducing, and in most cases actually increasing, the hot water capacity for the user.

Various features and advantages of the invention are set forth in the following claims.

What is claimed is:

1. A method of interfacing a natural convection vent construction with a water heater, the method comprising:

providing a water heater having a burner, a blower, and a flue;

creating products of combustion with the burner;

forcing the products of combustion into the flue under positive pressure with the blower;

interposing an exhaust plenum between the flue and the natural convection vent construction;

positioning a deflector in the exhaust plenum;

impinging the products of combustion upon the deflector to resist direct flow of the products of combustion through the plenum into the natural convection vent construction under the influence of the blower;

dropping the pressure of the products of combustion to near atmospheric pressure within the plenum; and permitting the products of combustion to rise out of the plenum and into the natural convection vent construction substantially entirely under the influence of natural convection.

2. The method of claim 1, wherein the natural convection vent construction includes a draft hood, the method further comprising mixing ambient air with the products of combustion as the products of combustion flow into the draft hood.

3. A method of interfacing a natural convection vent construction with a water heater, the method comprising:

providing a water heater having a heat exchanger for heating water, a power burner including a premix burner and a blower, a plenum, a deflector within the plenum, and a natural convention draft hood;

providing a fuel/air mixture to the premix burner;

combusting the fuel/air mixture with the premix burner to produce products of combustion;

increasing the pressure of the products of combustion above atmospheric pressure with the blower;

forcing the products of combustion into the heat exchanger with the blower;

heating water with the products of combustion in the heat exchanger;

placing the plenum in communication with the heat exchanger;

receiving the products of combustion under the influence of the power burner in the plenum from the heat exchanger;

uncoupling the products of combustion from the influence of the power burner within the plenum by dropping the pressure of the products of combustion to near atmospheric pressure;

placing the natural convection draft hood in communication with the plenum; and receiving in the draft hood the products of combustion at near atmospheric pressure from the plenum wherein the uncoupling step includes impinging the products of combustion upon the deflector as the products of combustion flow into the plenum under the influence of the power burner to resist direct flow of the products of combustion through the plenum into the natural convention draft hood under the influence of the power burner.

4. The method of claim 3, wherein the step of providing a water heater further includes providing a water tank for holding water to be heated; wherein the heat exchanger includes a flue tube extending through the water tank; and wherein the step of heating water includes heating the flue with the products of combustion and heating water in the tank by conduction through the flue.

5. The method of claim 4, further comprising providing a baffle in at least a portion of the flue tube; wherein the step of heating water with the products of combustion in the heat exchanger includes reducing velocity and pressure of the products of combustion in the flue tube with the baffle.

* * * * *